US007043949B2

(12) United States Patent
Ross et al.

(10) Patent No.: US 7,043,949 B2
(45) Date of Patent: May 16, 2006

(54) CHILD PROOF KEY FOR BARREL-HOUSED GUN LOCK

(75) Inventors: Larry Ross, Idyllwild, CA (US); Cruz Luna, Idyllwild, CA (US)

(73) Assignee: & Son, Inc., Idyllwild, CA (US)

( * ) Notice: Subject to any disclaimer, the term of this patent is extended or adjusted under 35 U.S.C. 154(b) by 0 days.

(21) Appl. No.: 10/199,629

(22) Filed: Jul. 17, 2002

(65) Prior Publication Data

US 2004/0011100 A1 Jan. 22, 2004

(51) Int. Cl.
*E05B 19/02* (2006.01)
*E05B 19/04* (2006.01)

(52) U.S. Cl. ..... 70/404; 70/408; 70/454; 70/459; 81/177.6

(58) Field of Classification Search ..... 70/404, 70/403, 396, 399, 407–409, 395, 458, 457, 70/453, 454, 459, 456 R; 42/66, 70.01, 70.11; 81/177.2, 177.6–177.9
See application file for complete search history.

(56) References Cited

U.S. PATENT DOCUMENTS 188,011 A * 3/1877 Hendricks
652,414 A * 6/1900 Wilson
1,083,438 A * 1/1914 Dohse
1,358,681 A * 11/1920 Parker
1,688,207 A * 10/1928 Del Rosso
1,766,784 A * 6/1930 Gregory
1,929,235 A * 10/1933 Bevington
2,951,405 A * 9/1960 Engquist
3,330,141 A * 7/1967 Greenwald
4,440,048 A * 4/1984 Stevens et al. ..... 81/440
5,235,833 A * 8/1993 Pinto ..... 70/471
5,421,180 A * 6/1995 Rojdev ..... 70/456 R
6,109,073 A * 8/2000 Parsons ..... 70/16

* cited by examiner

*Primary Examiner*—Lloyd A. Gall
(74) *Attorney, Agent, or Firm*—Steins & Associates, P.C.

(57) ABSTRACT

A Child Proof Key for Barrel-housed Gun Lock is disclosed. Also disclosed object of the present invention to provide a Child Proof Key for Barrel-housed Gun Lock. The lock includes a handle defined by a slot formed along its length for acceptance of the shaft. The shaft is hinged at one end which permits the shaft to be stowed within the shaft slot. The shaft terminates in a key socket at its head for engagement with the keyed head of a bore-housed gun lock. The key further includes a bushing along the length of the shaft for centering the key socket within the barrel of the weapon, and further to identify the size by indicia inscribable thereon (or other desirable indicia). Very importantly, the shaft slot formed in the handle is defined by a shoulder and a shaft bore, with the gap between the two shoulders being slightly smaller than the diameter of the shaft such that the shaft snaps into the slot when stowed. Once snapped in, the shoulders resist the removal of the shaft from the slot sufficiently to prevent a small child from utilizing the key to remove a locking device from a weapon. Still further, the key socket may include a pair of arcuate slots formed therein for engaging pins extending from the keyed head of a bore-housed gun lock.

18 Claims, 7 Drawing Sheets

CHILD PROOF KEY FOR BARREL-HOUSED GUN LOCK

BACKGROUND OF THE INVENTION

1. Field of the Invention

This invention relates generally to gun locks and their accessories and, more specifically, to a Child Proof Key for Barrel-housed Gun Lock 2. Description of Related Art In order to protect against accidental woundings, locks for firearms have become mandatory by law in some jurisdictions. One design of gun lock has become particularly prevalent—the bore-housed gun lock. An example of this type of lock can be found in Ross, U.S. Pat. No. 5,950,344. While a bore-housed gun lock is extremely effective at disabling a firearm, it is also fairly simple to remove if the individual has the proper key. In order to "child-proof" the gun lock, it has been typical for the adult firearm owner to store the key in a child-proof cabinet, container or location—typically separate from the firearm having the gun lock installed. The problem with this method of child-proofing is that when the owner wishes to use the firearm, he or she must first locate and obtain the hidden key. What is needed is a key for bore-housed gun locks that is childproof all by itself, so that the lock can be stored in a more convenient location without sacrificing the safety of the locked weapon.

SUMMARY OF THE INVENTION

In light of the aforementioned problems associated with the prior devices, it is an object of the present invention to provide a Child Proof Key for Barrel-housed Gun Lock. The lock should include a handle defined by a slot formed along its length for acceptance of the shaft. The shaft should terminate in a key socket at its head for engagement with the keyed head of a bore-housed gun lock. The key should further include a bushing along the length of the shaft for centering the key socket within the barrel of the weapon, and further to identify the size by indicia inscribable thereon (or other desirable indicia). Very importantly, the shaft slot formed in the handle should be defined by a shoulder and a shaft bore, with the gap between the two shoulders being slightly smaller than the diameter of the shaft such that the shaft snaps into the slot when stowed. Once snapped in, the shoulders should resist the removal of the shaft from the slot sufficiently to prevent a small child from utilizing the key to remove a locking device from a weapon. Still further, the key socket may include a pair of arcuate slots formed therein for engaging pins extending from the keyed head of a bore-housed gun lock.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a Child Proof Key for Barrel-housed Gun Lock.

Figure 1:
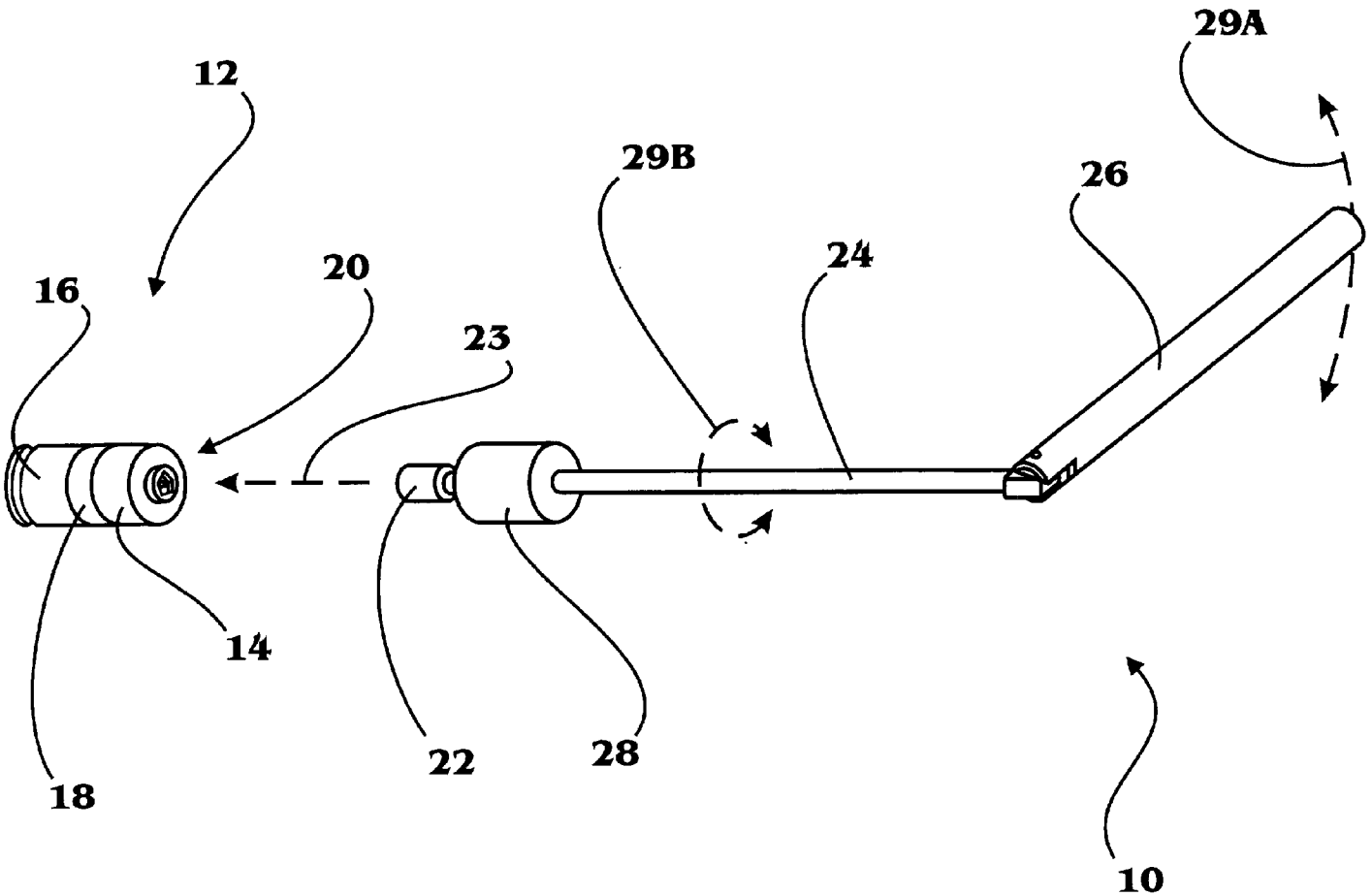
FIG. 1 is a perspective view of a preferred embodiment of the key assembly of the present invention and a bore-housed gun lock which it might be used to activate.

The present invention can best be understood by initial consideration of FIG. 1. FIG. 1 is a perspective view of a preferred embodiment of the key assembly 10 of the present invention and a bore-housed gun lock 12 which it might be used to activate. The depicted embodiment of the gun lock 12 is similar to those found in Ross, U.S. Pat. No. 5,950,344, and comprises a base 16 that is configured to either prevent the cylinder in a revolver from rotating, or to prevent the extractor finger on an automatic weapon from allowing the slide to move.

At the other end of the lock 12 is a head 14 in which a bore is formed for an actuating shaft terminating in a keyed head 20 to pass through. Between the head 14 and the base 16 is an expandable portion 18, such as a plastic or rubber grommet. When the keyed head 20 of the actuating shaft is turned, the head 14 is drawn towards the base 16, which places the expandable portion 18 under compression. The compression of the expandable portion 18 forces the outer surface of the expandable portion 18 to expand radially until a tight fit is created between the outer surface of the expandable portion 18 and the inner wall of either the gun's bore or the gun's breach (depending upon the type of weapon and lock).

The keyed head 20 includes either a recessed or protruding keyed portion. The keyed portion may be in a variety of configurations, depending upon the model of lock 12, for example, it may be a six-pointed female socket (similar to a Torx(tm)) interface. Other keying systems might also be used to prevent tampering with the lock 12.

The previous discussion is provided merely for a framework within which to understand the device of the present invention. As discussed above, absent some child-proof security related to the key assembly 10, a child might be able to unlock the weapon without adult supervision. To prevent that, the key assembly 10 of the present invention was created. The assembly comprises a handle 26 hingeably attached to a shaft 24. The shaft 24 terminates in a key socket 22 at its distal end. The key socket 22 is configured to interface with the keyed head 20 of the gun lock 12, after which it is a simple matter to lock or unlock the gun lock from the weapon by twisting the handle 26 along direction 29A, which results in rotation 29B of the shaft 24 and key socket 22.

At some point between the intersection of the handle 26 and shaft 24 and the key socket 22, is located a bushing 28. The bushing 28 is provided to center the key socket 22 within the bore of the weapon, so that it is extremely easy and quick to create a solid interface between the key socket 22 and the keyed head 20. Additional detail regarding the bushing 28 is provided below in connection with FIG. 6. Now turning to FIG. 2, we can examine the key assembly 10 in further detail.

Figure 2:
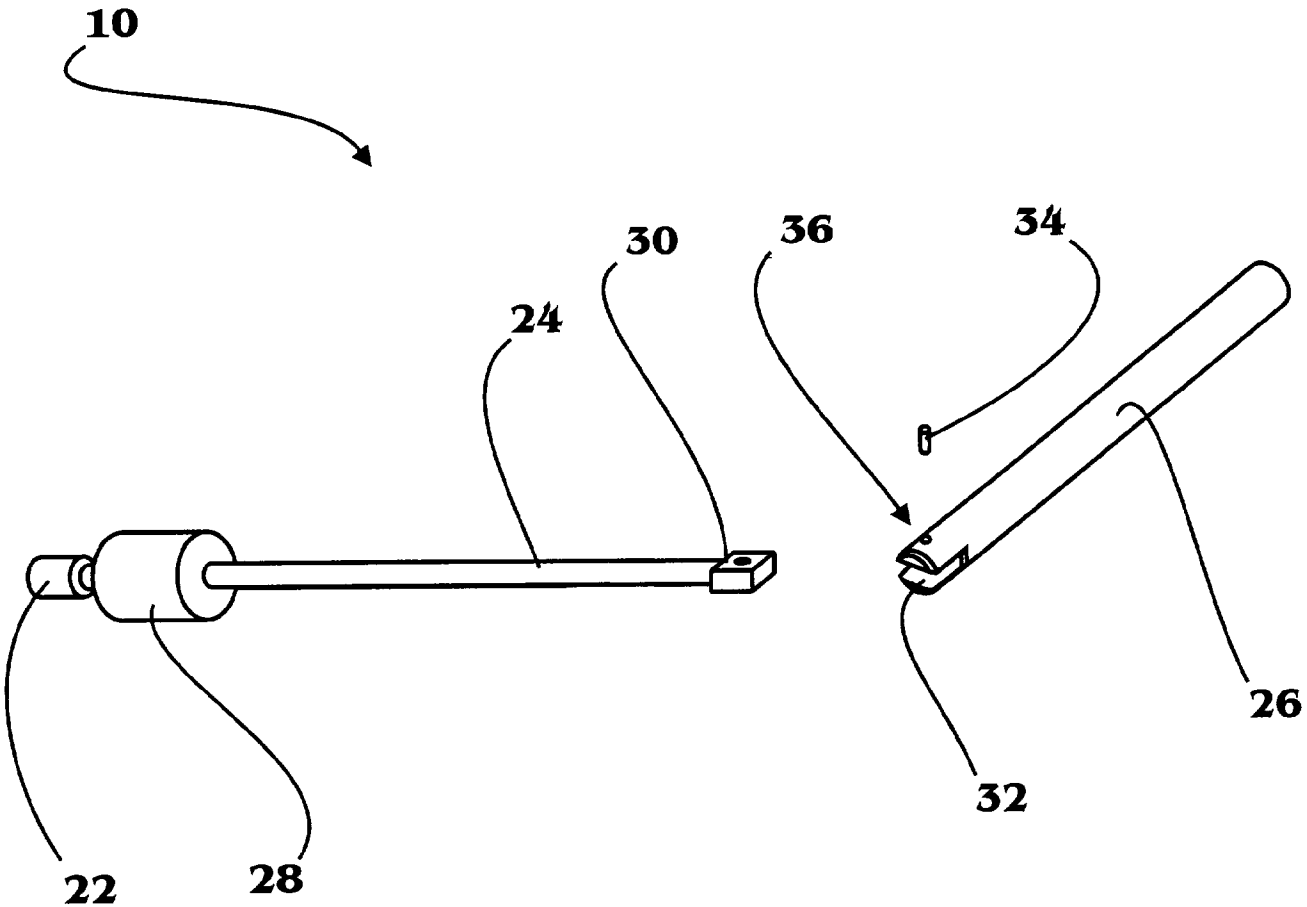
FIG. 2 is an exploded perspective view of the key assembly of FIG. 1.

FIG. 2 is an exploded perspective view of the key assembly 10 of FIG. 1. As shown, the shaft 24 terminates at its distal end in a key socket 22; at its opposite end it terminates in a pivot portion 30. The pivot portion 30 in this embodiment is a substantially flattened, rectangular shape having an aperture formed generally at its center. The pivot portion 30 is sized cooperatively with a pivot slot 32 formed in the handle 26 such that the pivot portion 30 can be slipped into the pivot slot 32. Once the pivot portion 30 is located properly within the pivot slot 32, a pivot pin 34 is inserted into a pivot aperture 36 formed in the handle 26. The pivot pin 34 is driven through the top pivot aperture 36, the aperture formed in the pivot portion 30, and into a bottom pivot aperture (not shown) formed on the handle bottom side of the pivot slot 32. The pivot pin 34 is preferably formed with the pivot apertures 36 to create an interference fit therebetween to retain the pin 34 in place once it has been inserted.

Once fully assembled, the cooperative sizing between the pivot portion 30 and pivot slot 32 permits the shaft 24 to be rotated relative to the handle 26 about the axis of the pivot pin 34 in a hinged fashion. Now turning to FIG. 3, we can further examine the operative details of the present invention.

Figure 3:
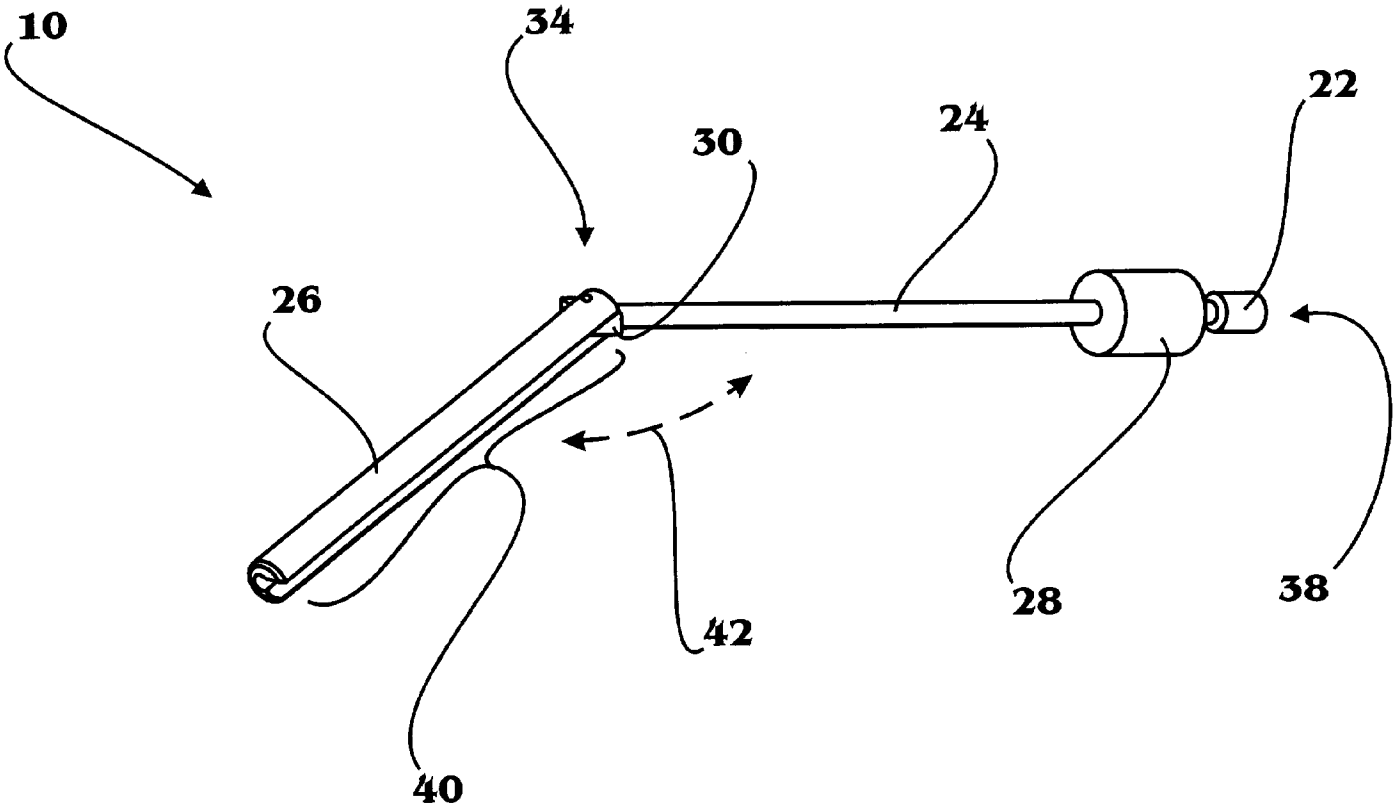
FIG. 3 is a perspective view of the key assembly of FIGS. 1 and 2.
Figure 4:
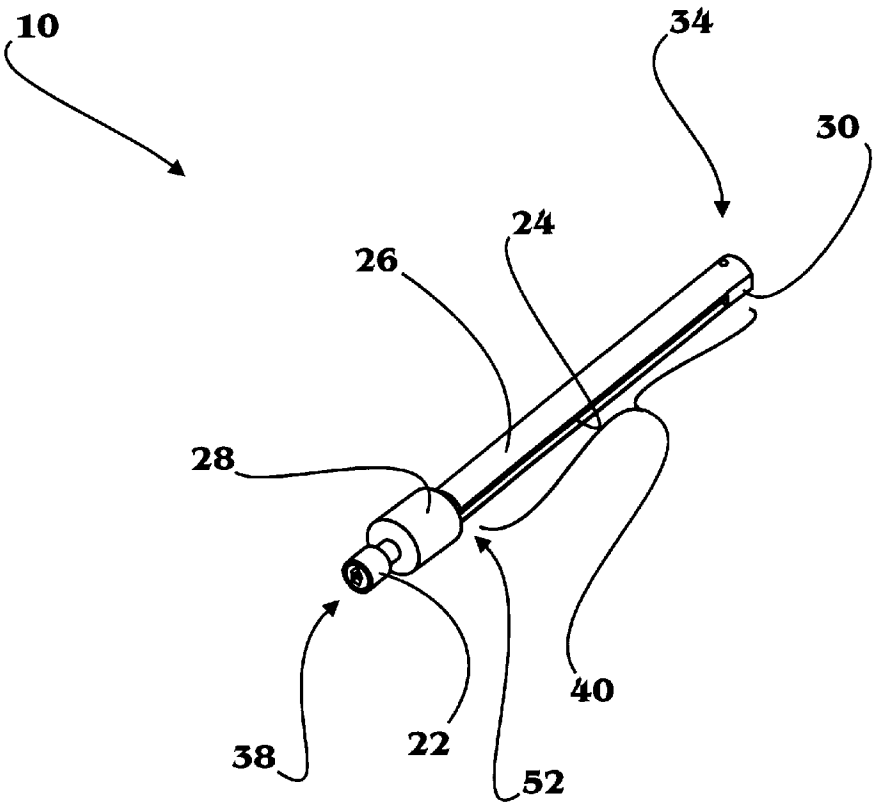
FIG. 4 is a perspective view of the key assembly of FIGS. 1–3, depicting the shaft in a stowed position.

FIG. 3 is a perspective view of the key assembly 10 of FIGS. 1 and 2. This view depicts the opposite side of the assembly 10 from that depicted above in FIG. 2. In this view, a shaft slot 40 formed in the handle 26 can be seen. It should be apparent that the shaft slot 40 is provided such that when the shaft 24 is rotated about the pivot pin 34, in direction 42, towards the handle 26, it will ultimately reach the shaft slot 40. As will be discussed further below, the shaft 24 can actually be folded into the shaft slot 40 so that it is completely retained within the handle 26; FIG. 4 depicts the this position.

FIG. 4 is a perspective view of the key assembly of FIGS. 1–3, depicting the shaft 24 in the stowed position. As can be seen, the entire shaft 24 resides within the shaft slot 40 formed in the handle 26. In fact, the structure of the distal end portion 52 of the slot 40 actually causes the shaft 24 to snap in to the slot 40, thereafter requiring not insubstantial force to pull the shaft 24 out of the slot 40.

As also shown in FIG. 4, the bushing 28 is preferably positioned along the length of the shaft 24 such that it is beyond the distal end of the handle 26 when the shaft 24 is in the stowed position. It should be noticed (for later reference) that the outer surface of the bushing 28 is fully exposed when the shaft 24 is in the stowed position. It should also be appreciated that the assembly 10 presents an sleek and compact package when the shaft 24 is in the stowed position as shown. Now turning to FIG. 5, we can examine the child-proof feature of the present invention.

Figure 5:
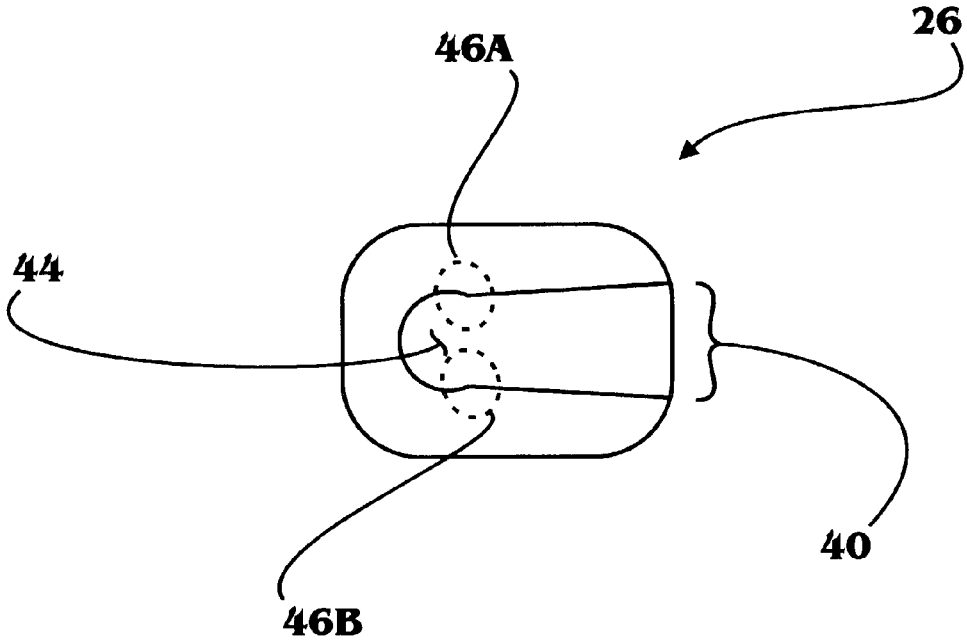
FIG. 5 is a cutaway end view of the handle of the key assembly of FIGS. 1–4.

FIG. 5 is a cutaway end view of the handle of the key assembly of FIGS. 1–4. Specifically, the distal end portion of the shaft slot 40 is depicted (in cross-section). As shown here, the slot 40 terminates in a shaft bore 44 at its bottom (i.e. the bottom of the slot). Shaft bore portion 44 of the slot 40 is substantially circular in cross-section in order to match the cross-section of the shaft (not shown). Where the shaft (not shown) has a cross-section that is other than circular, the shaft bore 44 cross-section will have a substantially similar (and other than circular) cross-section.

As the slot transitions from the straight-walled slot 40, to the curved-walled bore 44 portion, a pair of shoulders 46A and 46B are protruding. In fact, depending upon the particular model of key assembly, the shoulders 46A and 46B may extend the entire length of the shaft slot 40 (rather than just at its distal end). The shoulders 46 create a narrowing in the slot 40 that prevents the shaft (not shown) from slipping out of the slot 40 without the user first applying a substantial amount of force to the end of the shaft (not shown). Specifically, the amount of force necessary to release the shaft (not shown) from the slot 40 exceeds that amount that a typical child of ages 0 to 6 can exert upon the shaft. The result of the child's inability to remove the shaft (not shown) from the slot 40 is that the child cannot remove the barrel-housed gun lock from the weapon.

The operation of these shoulders 46 and the shaft (not shown) is known as a shaft restraint. Certainly it should be appreciated that other shaft restraint designs may be employed, including pins or levers that must be released or removed in order to release the shaft (not shown) from the slot.

In any of the aforementioned shaft restraint designs, since a child cannot un-stow the shaft (not shown), the child will not be able to achieve enough leverage in twisting the key assembly to unlock a bore-housed gun lock (see FIG. 1). Now turning to FIG. 6, we can examine the unique design and functionality of the bushing 28.

Figure 6:
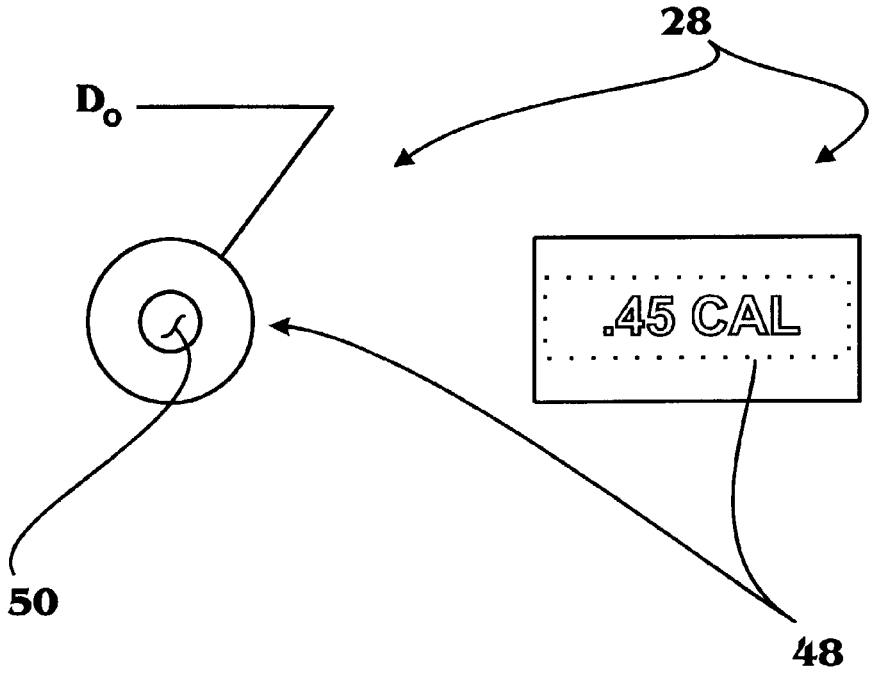
FIG. 6 is end and side views of the bushing of the key assembly of FIGS. 1–5.

FIG. 6 is end and side views of the bushing 28 of the key assembly of FIGS. 1–5. The bushing 28 is preferably constructed from a durable, yet non-marring material (e.g. plastic) that makes it safe to slip into a gun's barrel without a hazard of scratching or otherwise damaging the barrel.

The bushing 28 has a bore 50 formed substantially at its center that is cooperatively sized with the shaft (not shown) such that an interference fit exists between the two to keep the bushing 28 held firmly in place along the length of the shaft (not shown). The outer diameter $D_o$ of the bushing 28 is sized to correspond with the barrel diameter of the weapon for which the gun lock (see FIG. 1) is designed; the outer diameter $D_o$ is actually slightly smaller than the inner diameter of the weapon's barrel in order to permit the bushing 28 to slide easily into the barrel.

On the side of the bushing 28 is preferably located a display portion 48. In this embodiment, indicia that indicates the size of the gun barrel into which the bushing 28 is sized for is inscribed on the display portion 48. In this example, the size information is provided in the event that a particular owner has key assemblies for more than one size of weapon; it is simple for that owner to determine which key assembly goes with which weapon. In other designs, or on the alternate side of the bushing 28, other indicia may be inscribed.

Figure 7:
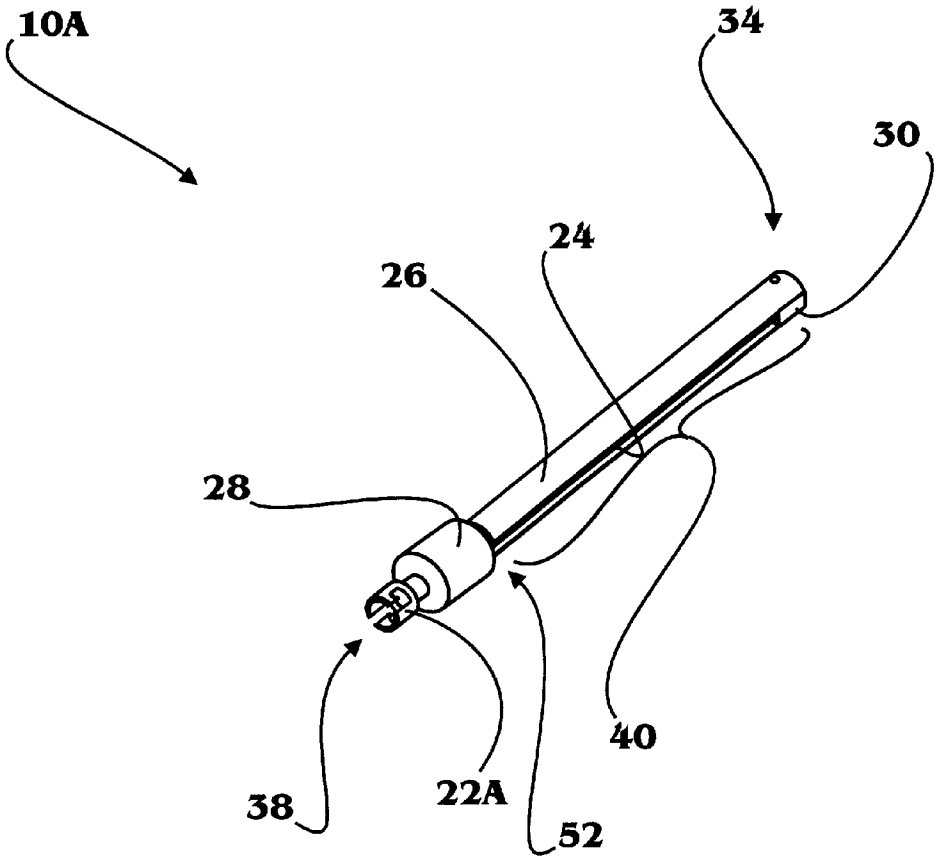
FIG. 7 is a perspective view of the key assembly of FIGS. 1–5 having an alternate key socket.

If we now turn to FIG. 7, we can examine another embodiment of the key socket 22A of the present invention. In particular, the key socket 22A depicted in FIG. 7 is designed for use with revolver barrel-housed gun locks. Because a barrel-housed lock (not shown) is extracted from the end of the barrel of the weapon rather than out through the breach, as is the case with automatic weapons, an alternate means for removing the lock (not shown) from the barrel is necessary. As depicted below in connection with FIG. 8, the revolver-type key socket permits the user to actually "hook" the keyed head of the gun lock (see FIG. 1) and then pull the entire gun lock (see FIG. 1) out through the barrel end. This is much quicker and easier than attempting to knock the lock out through the end of the barrel.

Figure 8:
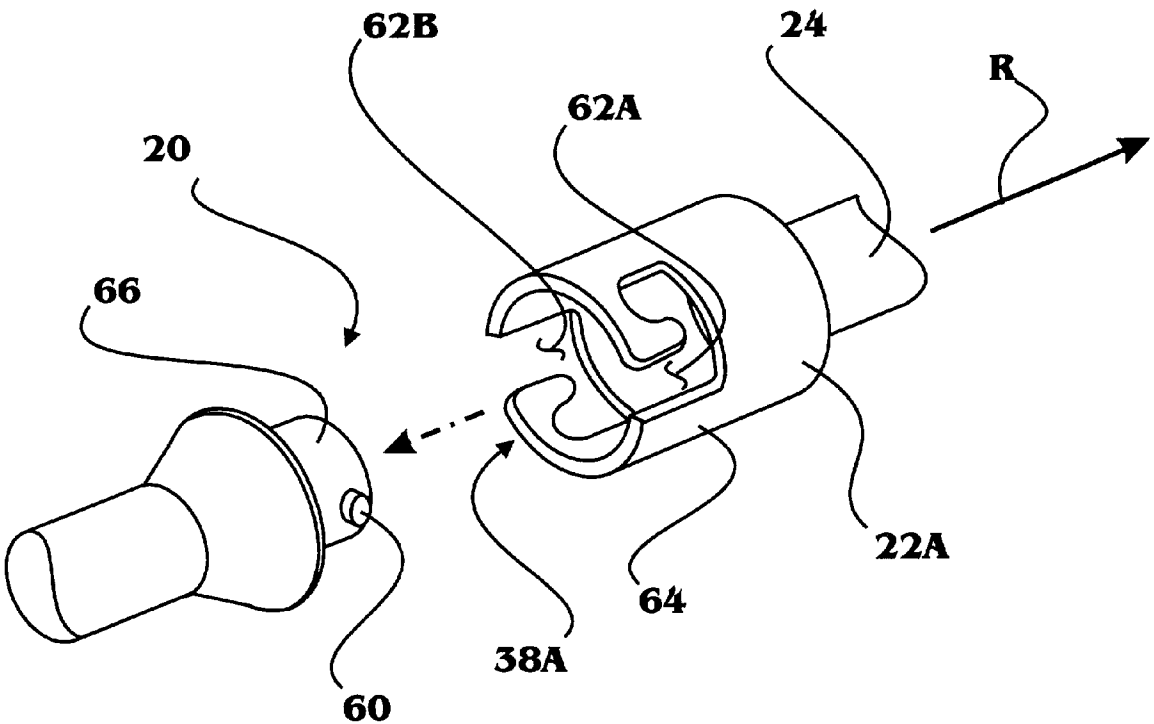
FIG. 8 is a partial perspective view of the key assembly of FIG. 7 and a cooperatively designed keyed head.

FIG. 8 is a partial perspective view of an alternate keyed head 20A and a cooperating key socket 22A as was first discussed above in connection with FIG. 7. As also discussed earlier, the alternate key socket 22A extends from the distal end of the shaft 24. In this embodiment, the key socket 22A is defined by a generally cylindrical tube 64 within which are formed arcuate slots 62A and 62B on opposing sides. The unique sizing and shape of the tube 64 and the slots 62 comprise the key 38A of this embodiment.

The keyed head 20A is configured to cooperate with the design of the key socket 22A. Specifically, the head 20A will include a pin 66 extending outwardly from one end of the head 20A. The diameter of the pin 66 is such that it is insertible into the end of the key socket 22A (actually, the key socket is insertible over the end of the pin 66). As the socket 22A is inserted over the pin 66, a pair of opposing fingers (only one, element 60 shown here) will be accepted into the slots 62.

As the socket 22A is fully depressed and then twisted, it should be apparent that the arcuately-shaped slots 62 will engage the fingers 60 to actually capture the fingers 60 at the closed ends of the slots 62. The slots 62 are generally "L"-shaped and commence along generally parallel walls and terminate in a curved face at their end. Once captured, it should be apparent that pulling on the shaft 24 in direction "R" will pull the keyed head 20A (and the other components of the gun lock (not shown)) in the same direction. It is in this manner that a lock would be removed from the barrel of the revolver (not shown).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A child-resistant key for bore-housed gun locks defined by a keyed head, comprising:

a shaft terminating in a key socket at one end and terminating in a pivot end opposite said key socket;

a handle defined by a shaft slot, said shaft and shaft slot cooperatively dimensioned whereby said shaft can be placed within said slot;

a bushing attached to said shaft between said key socket and said pivot end; and a shaft restraint associated with said handle.

2. The key of claim 1, wherein said pivot end comprises a pivot portion defined by an aperture; and said handle is further defined by a pivot end, said pivot end further defined by a pivot slot, said pivot slot cooperatively sized to accept said pivot portion.

3. The key of claim 2, wherein said bushing attached to said shaft between a distal end and said pivot end defines an outer diameter greater than an outer diameter defined by said key socket, said key socket further defining an outer diameter greater than said shaft.

4. The key of claim 3, further comprising:

a pair of pivot apertures formed proximate said pivot slot; and a pivot pin inserted through one said pivot aperture, subsequently through said aperture formed in said pivot portion, and through said other pivot aperture to form a pivot hinge between said shaft and said handle.

5. The key of claim 4, wherein said handle defines a longitudinal axis and said shaft slot is defined by a pair of opposing walls that terminate in a shaft bore, said shaft bore being substantially parallel to said longitudinal axis.

6. The key of claim 5, wherein said shaft slot is defined by a pair of shoulders formed substantially at the junction of said shaft slot walls and said shaft bore.

7. The key of claim 6, wherein said key socket further comprises a tubular portion defined by a wall, said wall further including at least one arcuate slot formed therein.

8. The key of claim 7, wherein:

said tubular portion is defined by a shaft end, an open distal end and a wall; and said key socket is defined by a pair of arcuate slots formed on opposite sides of said wall.

9. The key of claim 8, wherein each said arcuate slot is defined by a longitudinal section having generally parallel walls in spaced relation and commencing at a face of said key socket, said slot terminating in a curved portion opposite said face of said key socket.

10. A child-resistant key assembly, comprising a shaft defining a pivot end and terminating in a key socket at an end opposite said pivot end, said key socket further, comprising a tubular portion defined by a wall, said wall further including at least one arcuate slot formed therein, each said arcuate slot defined by a longitudinal section having generally parallel walls in spaced relation and commencing at a face of said key socket, said slot terminating in a curved portion opposite said face of said key socket; and a bushing fixed to and encircling said shaft between said pivot end and said key socket.

11. The assembly of claim 10, wherein:

said tubular portion is defined by a shaft end, an open distal end and a wall; and said key socket is defined by a pair of arcuate slots formed on opposite sides of said wall.

12. The assembly of claim 11, further comprising:

a handle defined by a shaft slot, said shaft and shaft slot cooperatively dimensioned whereby said shaft can be placed within said slot; and a shaft restraint associated with said handle.

13. The assembly of claim 12, wherein said shaft terminates at said pivot end in a pivot portion defined by an aperture; and said handle is further defined by a pivot end, said pivot end further defined by a pivot slot, said pivot slot cooperatively sized to accept said pivot portion.

14. The assembly of claim 13, further comprising:

a pair of pivot apertures formed proximate said pivot slot; and a pivot pin inserted through one said pivot aperture, subsequently through said aperture formed in said pivot portion, and through said other pivot aperture to form a pivot hinge between said shaft and said handle.

15. The assembly of claim 14, wherein said shaft terminates in a distal end opposite said pivot end, said key socket formed at said distal end.

16. The assembly of claim 15, wherein said handle defines a longitudinal axis and said shaft slot is defined by a pair of opposing walls that terminate in a shaft bore, said shaft bore being substantially parallel to said longitudinal axis.

17. The assembly of claim 16, wherein said shaft slot is defined by a pair of shoulders.

18. The assembly of claim 17, wherein:

said key socket defines a circular outer perimeter having a socket diameter; and said bushing defines an outer perimeter having a bushing diameter, said bushing diameter being greater than said socket diameter.

* * * * *